US006729284B2

(12) United States Patent
Lunsford

(10) Patent No.: US 6,729,284 B2
(45) **Date of Patent: *May 4, 2004**

(54) INTERNAL COMBUSTION ENGINE WITH VARIABLE CAM TIMING OIL FILTER WITH RESTRICTOR ARRANGEMENT

(75) Inventor: Robert Wayne Lunsford, Walled Lake, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/226,277

(22) Filed: Aug. 22, 2002

(65) Prior Publication Data

US 2002/0189561 A1 Dec. 19, 2002

Related U.S. Application Data

(63) Continuation of application No. 09/803,288, filed on Mar. 10, 2001.

(51) Int. Cl.[7] ..... F01M 1/06

(52) U.S. Cl. ..... 123/90.33; 123/90.15; 123/90.17; 123/196 A

(58) Field of Search ..... 123/90.15, 90.16, 123/90.17, 90.33, 90.34, 90.196, 901.196 R, 196 A

(56) References Cited

U.S. PATENT DOCUMENTS

| | | | | | |
|---|---|---|---|---|---|
| 4,524,733 | A | | 6/1985 | Schmidt | |
| 4,800,850 | A | | 1/1989 | Yoshida et al. | |
| 4,928,641 | A | | 5/1990 | Niizato et al. | |
| 5,143,034 | A | | 9/1992 | Hirose | |
| 5,220,891 | A | | 6/1993 | Nakamura et al. | |
| 5,524,581 | A | * | 6/1996 | Rush, II et al. | 123/90.34 |
| 5,588,405 | A | * | 12/1996 | Sawa et al. | 123/90.33 |
| 5,718,196 | A | * | 2/1998 | Uchiyama et al. | 123/195 C |
| 5,797,363 | A | * | 8/1998 | Nakamura | 123/90.17 |
| 5,954,019 | A | * | 9/1999 | Yoshikawa et al. | 123/90.17 |
| 6,035,817 | A | * | 3/2000 | Uchida | 123/90.17 |
| 6,182,624 | B1 | * | 2/2001 | Ozeki | 123/90.33 |
| 6,182,625 | B1 | * | 2/2001 | Ozeki et al. | 123/90.33 |
| 6,202,612 | B1 | * | 3/2001 | Haag | 123/90.34 |
| 6,263,844 | B1 | * | 7/2001 | Ozeki et al. | 123/90.17 |
| 6,484,680 | B2 | * | 11/2002 | Lunsford | 123/90.33 |

* cited by examiner

*Primary Examiner*—Thomas Denion
*Assistant Examiner*—Ching Chang
(74) *Attorney, Agent, or Firm*—Dykema Gossett PLLC; Carlos Hanze

(57) ABSTRACT

An automotive engine arrangement 7 is provided having a VCT unit 96 wherein a lubrication oil restrictor 152 is incorporated with the VCT unit oil filter 127. The arrangement 7 of the present invention allows for VCT unit oil filter 127 to be installed in a cylinder head 18 of an automotive engine block 10 wherein placement of the VCT unit oil filter 127 in the appropriate location automatically installs the restrictor.

15 Claims, 3 Drawing Sheets

INTERNAL COMBUSTION ENGINE WITH VARIABLE CAM TIMING OIL FILTER WITH RESTRICTOR ARRANGEMENT

This application is a continuation of prior application Ser. No. 09/803,288, filed Mar. 10, 2001.

FIELD OF THE INVENTION

The field of the present invention is that of an arrangement of an internal combustion engine with a variable timed camshaft. More particularly, the present invention relates to an arrangement of a pressurized fluid supply and filter for an automotive internal combustion engine with a variable timed camshaft.

BACKGROUND OF THE INVENTION

Automotive vehicle engines with reciprocal pistons typically have a plurality of cylinder combustion chambers with the reciprocating pistons being mounted therein. Each piston is pivotally connected with a piston rod, which is pivotally connected with a crankshaft. At an end of the crankshaft a timing gear is mounted. Typically, each cylinder has at least one intake valve and one exhaust valve. Both the intake valve and the exhaust valve are spring loaded to a closed position. Each intake and exhaust valve is associated with a rocker arm. To operate the valves, the rocker arms are moved by a set of contacting cam lobes. The cam lobes are mounted on an elongated member known as a camshaft. Attached at an extreme end of the camshaft is a camshaft pulley. The camshaft pulley is powered by the crankshaft via a timing chain or belt which is looped over the camshaft pulley and a crankshaft timing gear. Accordingly, the camshaft is synchronized with the crankshaft and the timing of the opening and closing of the intake and exhaust valves is fixed with respect to the position of the piston within the cylinder combustion chamber.

In an effort to improve the environment by decreasing polluting emissions and increasing vehicle gas mileage, it has become desirable to allow the timing of the cylinder valve operation to vary with respect to the piston position within the cylinder chamber. To provide for the variable valve timing operation, a variable cam timing unit (VCT) provided on the camshaft.

An example of a VCT is a dual oil feed vane-type VCT. A dual oil feed vane-type variable cam timing unit provides an inner member or hub that is fixably connected to an end face of a camshaft. The hub has a series of vanes which are captured in cavities or pressure chambers provided in an outer member which is concentrically mounted on the hub. The outer member incorporates the camshaft timing pulley. The vanes circumferentially bifurcate the pressure chambers into an advance side and a retard side. A spool valve, fluidly communicative with the pressure chambers via the inner member and the camshaft, controls the fluid pressure in the advance side and retard side of the pressure chambers. Accordingly, the angular position of the timing pulley versus the crankshaft can be varied by controlling the fluid in the advance and retard pressure chambers.

The VCT utilizes engine lubricating oil pressure and flow to phase the camshaft. The VCT must meet minimum phase speed requirements to achieve desired fuel economy, emission benefits, acceptable drivability, and the avoidance of stall conditions.

Most automotive engines are formed from a cast iron or aluminum engine block. The lower portion of the block forms the combustion chamber and a crankshaft cavity. An upper portion of the block forms a top portion of the combustion chamber and is commonly referred to as the cylinder head. The head also mounts the crankshaft and idler arms. To lubricate the rotating portions of the engine, which are mounted in the cylinder head, there is provided a generally vertical or vertically inclined lubrication passage that extends from the main oil gallery. The main oil gallery is typically located in the lower portion of the engine block laterally above the crankshaft. The generally vertical passage extends to an intersecting vertically extending passage formed in the cylinder head. The vertically extending passage in the cylinder head is intersected by a horizontally extending cylinder head main oil gallery. The cylinder head main oil gallery then feeds off to the separate camshaft bearings and idler arms and other various lubrication areas. To prevent excessive oil going to the cylinder head main oil gallery there is typically provided a restrictor, which is often incorporated inside the head gasket between the lower portion of the engine block and the cylinder head. The restrictor limits the flow of oil to the cylinder head and therefore ensures the proper flow of lubricating oil to the other lubrication areas located within the lower engine block portion.

VCT systems typically have a solenoid that feeds the pressurized oil to the VCT unit on the end of the camshaft. A filter is required for the oil which is fed to the VCT spool valve and the VCT unit to protect them from damage from contaminants which can pass through the main engine oil filter. Additionally since the VCT unit in certain phases of engine operation can demand the maximum available pressure (15 psi gage) and flow output of the engine oil pump, it is desirable that the VCT supply passage to the solenoid in the VCT system be free of restrictions as possible.

Typically the supply passage which feeds the solenoid for the VCT control valve intersects the aforementioned generally vertically extending lubrication passage which connects the main oil gallery with the cylinder head main oil gallery. Prior to the present invention, the filter was placed within the lubrication passage within the cylinder head where the generally vertical lubrication passage intersected with the VCT oil supply passage. After filter insertion, a restrictor—which was typically a plug with a predefined hole drilled therein—was placed within the vertical passage. The use of a plug was disadvantageous for several reasons. Unlike the restrictor, which was incorporated into the head gasket, a plug provided another part to the assembly process, and had a risk of being misassembled or inadvertently omitted. Further, the restrictor was typically a polymeric substance which, over long periods of exposure to high temperatures and lubricating oil, tended to lose some of its desired design material characteristics. Finally, the addition of the plug to the restrictor added to the cost of manufacturing the engine.

The insertion of a restrictor could be eliminated if a separate lubrication passage was provided exclusively for the VCT unit. However, a separate exclusive oil lubrication passage would significantly add to engine manufacturing costs.

It is desirable to provide a restrictor at a lower cost for an automotive engine having a VCT unit. It is desirable to provide a restrictor which during the assembly process does not carry the risk of being misassembled or inadvertently omitted.

SUMMARY OF THE INVENTION

To make manifest the above delineated and other desires, a revelation of the present invention is brought forth. In a preferred embodiment the present invention provides an automotive engine arrangement having a VCT unit wherein the restrictor is incorporated within the VCT unit oil filter. The arrangement of the present invention allows for a filter unit to be installed in the head of an automotive engine and wherein placement of the filter in the appropriate location automatically installs the restrictor. Since the restrictor is incorporated inside the VCT filter, no additional parts are required. Incorporating the restrictor in the filter eliminates any requirement for the assembly of a separate restrictor.

It is an advantage of the internal combustion engine of the present invention to provide a VCT filter that incorporates a restrictor.

Other advantages of the invention will become apparent to those skilled in the art upon a reading of the following detailed description and upon reference to the drawings.

DETAILED DESCRIPTION OF THE INVENTION

Figure 1:
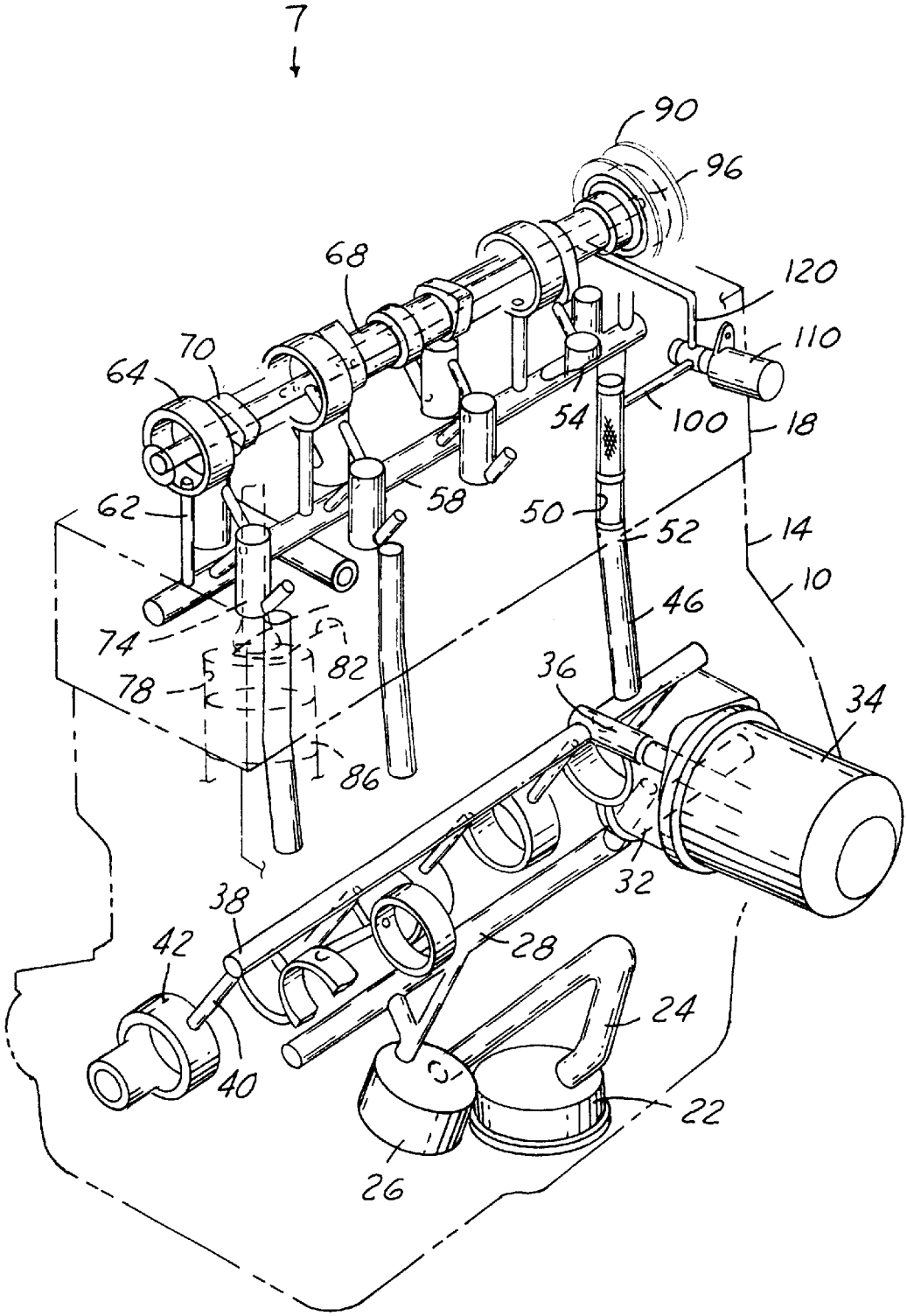
FIG. 1 is a perspective view of an engine block illustrating the major components of the oil distribution system of an internal combustion engine arrangement according to the present invention.

Referring to FIG. 1, an automotive internal combustion engine arrangement 7 according to the present invention has an engine block 10. The engine block has a lower portion 14. The engine block also has an upper portion referred to as the cylinder head 18. Attached to the engine block lower portion 14 is an oil pan or sump 22 which is connected to an oil passage 24. The oil passage 24 is in turn connected to an oil pump 26. The oil pump 26 is connected to an oil passage 28. The oil passage 28 is fluidly connected with an oil filter housing 32. The oil filter housing 32 has threadably connected thereto a conventional oil filter 34. The outlet of the oil filter 34 is connected with an oil passage 36. The oil passage 36 intersects a main oil gallery 38 which has various intersecting branches 40 that deliver pressurized oil to crankshaft bearings 42. The main oil gallery 38 is fluidly connected with a generally vertically extending oil passage 46. The oil passage 46 extends generally vertically upwards in a straight engine and is typically vertically inclined in a V engine. Oil passage 46 is generally aligned with an oil passage or first oil passage 50 provided in the cylinder head 18. Oil passage 50 has an inlet 52 and an outlet 54. Oil passage 50 and its outlet 54 intersect a cylinder head main oil gallery 58. The cylinder head gallery 58 extends generally horizontally along the length of the engine 7 and has a plurality of intersecting branches 62. The branches 62 deliver pressurized lubricating oil to the camshaft bearings 64.

The engine arrangement 7 has a camshaft 68. The camshaft 68 has press fitted thereon a series of lobes 70. The cam lobes 70 are operatively associated with rocker arms or tappets (not shown) which operate the opening and closing operation of a series of poppet valves 74. The cam lobes 70 in other engine embodiments may be associated with finger follower valve trains or other mechanical arrangements. The poppet valves are operated to either open or close a combustion chamber 78 from an inlet or exhaust passage (only partially shown) 82 to control air flow in a manner well known in the art. Each combustion chamber 78 slidably mounts a reciprocating piston 86 therein. The camshaft 68 is turned by a pulley unit 90. The pulley unit 90 is meshed with a timing belt (not shown) which is turned by the crankshaft (not shown). The reciprocating piston 86 is pivotally connected with the crankshaft by a piston rod (not shown). The angular position of the crankshaft is directly, related to the angular position of the camshaft. Accordingly, the angular position of the camshaft 68 will be directly related to the position of the piston 86 within the combustion chamber 78 due to the pivotal connection of piston 86 with the crankshaft. To allow for a phasing of the position of the crankshaft with respect to the position of the piston 86, there is provided a VCT unit 96. The VCT unit 96 can be one of several conventional designs and an excellent example is shown in co-pending U.S. patent application Ser. No. 09/742,707.

Figure 2:
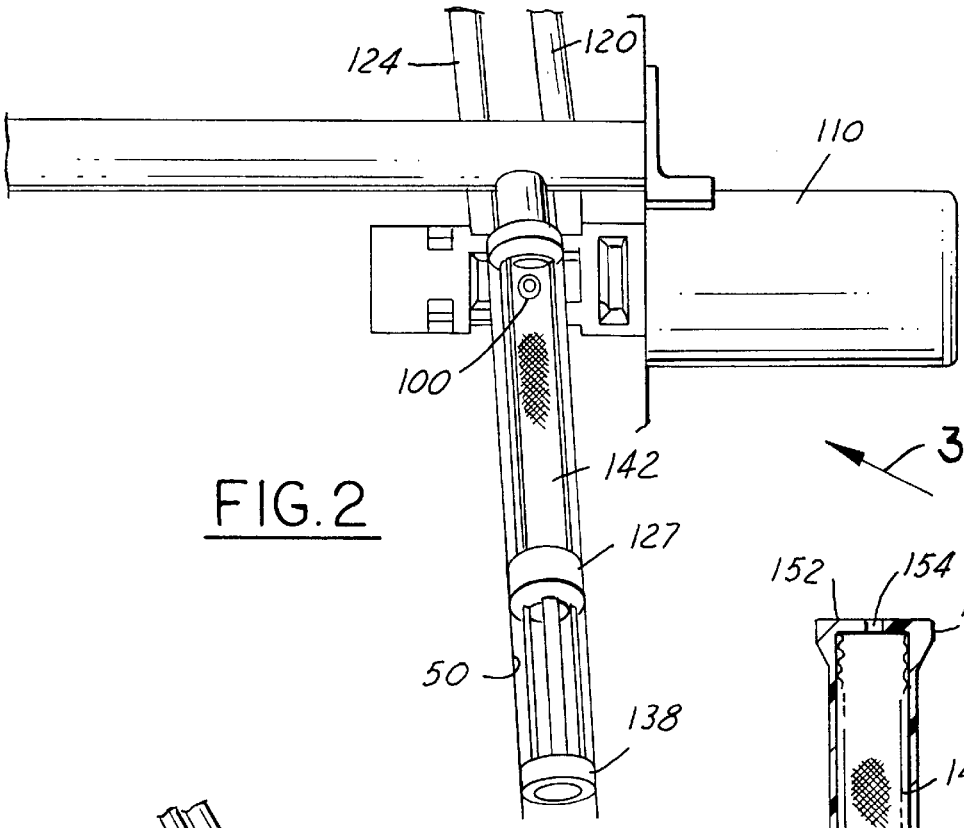
FIG. 2 is a perspective view showing installation of the VCT oil filter according to the present invention.
Figure 3:
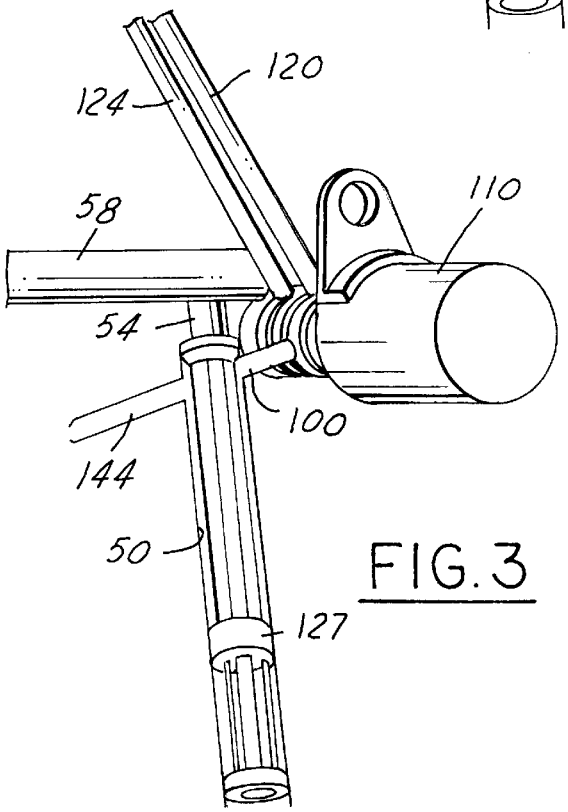
FIG. 3 is a view taken along line 3 of FIG. 2.

To phase the rotation of the camshaft 68 with respect to the location of the piston 86, the VCT unit 96 must be supplied with pressurized oil. In FIG. 1, the oil supply passages extending between the first passage 50 and the VCT unit 96 have been modified for clarity of illustration and the actual physical relationships are shown in FIGS. 2–3. Additionally, a line which delivers pressurized oil from a VCT solenoid valve 110 to the VCT unit 96 for the advanced mode of operation has been deleted for clarity of illustration.

Figure 4:
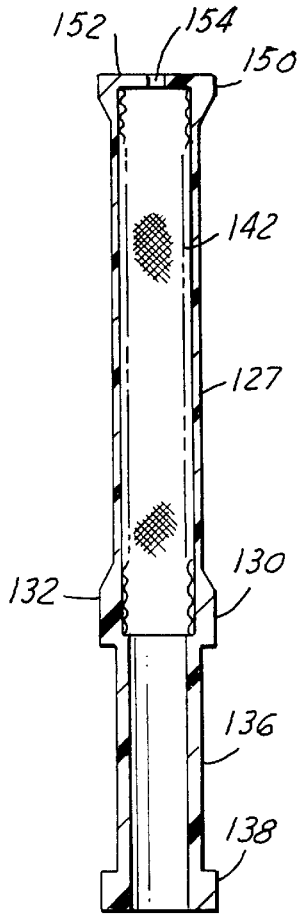
FIG. 4 is a sectional view of the VCT filter shown in FIGS. 1–3.

Turning additionally to FIGS. 2–4, the second passage 100 delivers oil from the first passage 50 to the VCT solenoid 110. As shown in FIGS. 1–3, the second passage 100 is non-coextending with the first passage and has an inlet which intersects the first passage 50 between the first passage inlet 52 and outlet 54. The VCT solenoid valve 110 has a retard outlet 120 that delivers oil to the VCT unit 96 for retard phase operation. Additionally, the VCT solenoid valve 110 has an intersecting line 124 for delivering oil to the VCT unit 96 for advance phase operation.

Inserted within the first passage 50 is an oil filter 127 according to the present invention. The oil filter 127 has an inlet frame 130, which is typically made a polymeric material such as nylon. The inlet frame is generally annular in shape and its outer annular periphery 132 generally seals with the first passage 50.

Extending downward from the inlet frame 130 is an integral support 136. The support 136 has a footer 138, which, in applications where the filter 127 is inserted from a side of the first passage closer to a top end of the cylinder head 18, can be sized to make contact with a smaller diameter, generally vertical oil passage 46 at the interface between the cylinder head 18 and the engine block lower portion 14.

Connected to the main inlet frame 130 is a filter media 142. The filter media 142 as shown in FIG. 4, is provided by a tubular cylinder of threaded stainless steel. Typically, the stainless steel threaded media will filter out impurities of 200 microns from passing to a radial exterior of the filter media 142. Oil passing through the filter media 142 will be radially exposed to the second passage 100. The second passage 100 has a blind end 144, best shown in FIG. 3, which is provided for manufacturing convenience. In other embodiments, the blind end 144 can be ended by a threaded plug, threadably inserted therein. The filter media 142 is connected to an outlet 150. The outlet 150 can be molded integrally with the inlet frame 130. The outlet 150 has a closed end 152 which is penetrated by a bore 154.

In operation, pressurized oil delivered by the oil pump 26 is passed through the filter 34 into the main oil gallery 38. From main oil gallery 38, the pressurized oil is delivered to the lubrication points in the cylinder head 18 via the oil passage 46. The oil passage 46 intersects with the first oil passage 50 and the oil then enters the inlet frame 130 into the filter media 142. A portion of the oil passes through the filter media 142 into an encircling radial chamber formed within the first passage 50. The radial chamber encircling the filter media 142 is intersected by the second passage 100. Oil in the second passage 100 is delivered to the VCT unit solenoid valve 110 and as required by the engine controller, is either held or delivered or relieved through the VCT's retard line 120 or advance line 124.

Restriction is needed to prevent an excessive amount of oil from passing through the first supply passage 50 and to the cylinder head lubrication points instead of to the various lubrication points in the engine block lower portion 14. Accordingly, the outlet 150 forms a restrictor impeding the passage of oil from the first passage 50 to the intersecting cylinder head oil supply gallery 58. Placement of the filter 127 within the first passage 50 automatically places the restrictor in its appropriate location.

Figure 7:
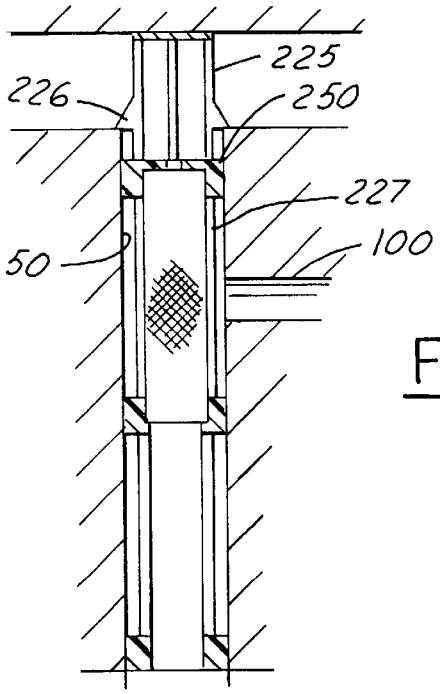
FIG. 7 is a sectional view similar to that of FIG. 4 of an alternate preferred embodiment VCT oil filter according to the present invention.

In the embodiment of the invention shown in FIG. 7, the filter 227 is inserted from the top end. Accordingly, the filter 227 has a snap fit retainer 225 which holds the restrictor outlet portion 250 of the filter in position. This design is especially appropriate in designs where access to the main oil passage 50 can be made from above rather than just below. The retainer has wings or lugs 226 to keep it in position.

Figure 5:
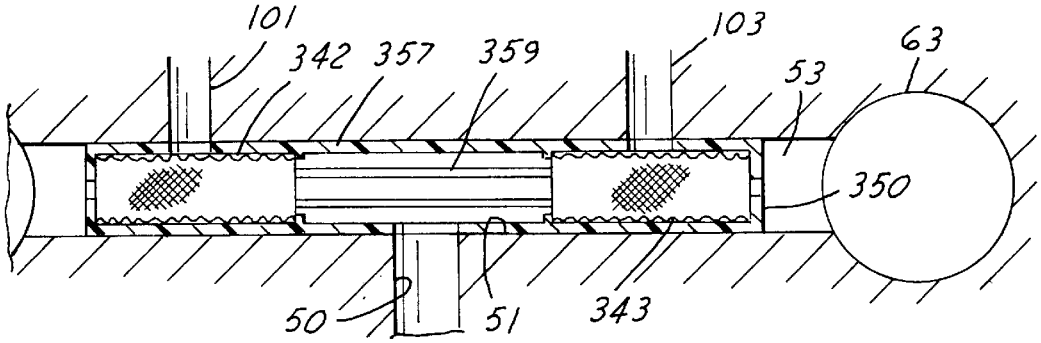
FIG. 5 is a sectional view of an alternate preferred embodiment VCT oil filter according to the present invention for use in internal combustion engines having dual VCT units.

In an alternate engine design, there are two VCT units for two separate camshafts (FIG. 5). The first passage 50 extends into a cross bore 51 and has an outlet 53. The outlet 53 fluidly communicates with the cylinder head main oil gallery 63. Intersecting the cross bore 51 are two VCT supply passages 101, 103. The filter 357 has two filter media 342, 343 which are radially exposed to the VCT supply passages. The filter 357 has a restrictor 350 to allow restricted flow to the cylinder head main oil gallery 63. A center or main body of the filter 357 has supports 359 to allow oil between the cross bore 51 and the side of the filter to enter into the interior of the filter and then pass through the opposite filter media 342, 343 before exiting to the VCT supply lines.

Figure 6:
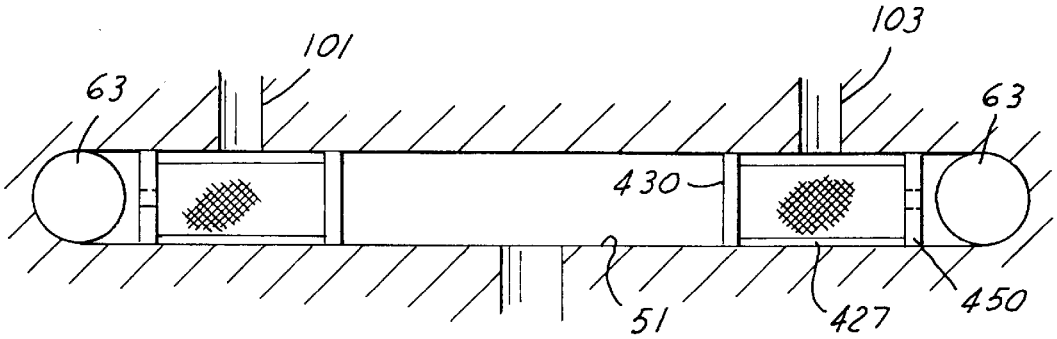
FIG. 6 is a view similar to that of FIG. 5, illustrating an engine arrangement which has two separate VCT oil filters according to the present invention.

Referring now to FIG. 6, an engine arrangement similar to that of FIG. 5 has separate filters 427. The filters 427 have an inlet frame portion 430 and outlet restrictor portions 450. The restrictor portions 450 allow restricted flow into dual cylinder head oil galleries 63.

While preferred embodiments of the present invention have been disclosed, it is to be understood that they have been disclosed by way of example only and that various modifications can be made without departing from the spirit and scope of the invention as it is encompassed by the following claims.

I claim:

1. A filter for a reciprocating piston internal combustion engine having a pressurized oil lubrication system and a variable cam timing unit, said engine having a first passage with an inlet and an outlet and a second passage having an inlet intersecting said first passage between said first passage inlet and outlet, said second passage being non-collinear supplying oil to said variable cam timing unit, said filter comprising:

a generally annular inlet frame for placement in said first passage;

a filter media having an inlet connected with said inlet frame, said filter media having a portion for filtering oil exposed to said second passage; and a restrictor connected with said filter media forming an outlet for said filter within said first passage restricting oil exiting said first passage outlet only.

2. A filter as described in claim 1, wherein said filter media has a portion for radial exposure to said second passage.

3. A filter as described in claim 1, wherein said inlet frame seals said first passage along an outer annular periphery.

4. A filter as described in claim 1, wherein said filter media is a threaded metal.

5. A filter as described in claim 4, wherein said filter media threaded metal is stainless steel.

6. A filter as described in claim 1, wherein there is an annular space about said filter media forming an annular chamber within said first passage exposed to said second passage.

7. A filter as described in claim 1, having supports extending beyond said filter inlet frame.

8. A filter as described in claim 1, further including a retainer to position said filter within a predetermined location within said first passage.

9. A filter as described in claim 1, having two spaced apart filter media exposed to separate second passages.

10. An automotive engine arrangement, comprising:

an engine block with at least a first combustion chamber for slidably mounting a reciprocating piston therein;

a valve for controlling airflow through an air passage connected with said combustion chamber;

a camshaft for controlling operation of said valve;

a variable cam timing unit to phase an operation of said valve with respect to a position of said piston;

a pressurized oil lubrication system to supply pressurized oil to said variable cam timing unit and to at least one other moving component mounted within said engine block, said lubrication system including a first passage having an inlet and an outlet intersected by an inlet of a variable cam timing unit second passage between said first passage inlet and outlet, said second passage being non-coextending with said first passage; and a filter for insertion within said first passage, said filter having a body with an inlet and an outlet, said filter additionally having a filter media, said filter media being exposed to said second passage to allow oil passing to said second passage to be filtered, and said filter having a restricted outlet to only restrict the flow of said lubricating oil through said first passage outlet to supply said moving component.

11. An automotive engine arrangement as described in claim 10, wherein said filter has a media radially exposed to said second passage.

12. An automotive engine arrangement as described in claim 10, wherein said first passage intersects an interface between a lower portion and an upper cylinder head portion of said engine block and said filter is positioned within said upper cylinder head portion.

13. An engine arrangement as described in claim 12, wherein there are two variable cam timing units and two second passages intersecting said first passage and wherein said filter has two filter media, each filter being exposed to one of said second passages.

14. An engine arrangement as described in claim 12, wherein there are two VCT units and two second passages intersecting said first passages and wherein there are two filters, each having a filter media being exposed to one of said second passages and each filter having a restrictor to provide for restricted flow to separate outlets.

15. A method of assembling a reciprocating piston internal combustion engine having a pressurized oil lubrication system and a variable cam timing unit and a first passage with an inlet and an outlet and a second passage with an inlet intersecting the first passage between said first passage inlet and outlet to supply oil to said variable cam timing unit, said second passage being non-coextending with said first passage, said method comprising:

inserting within said first passage a filter having a generally annular inlet frame and a filter media having an inlet connected with said inlet frame for filtering oil exposed to said second passage and a restrictor connected on said filter media forming an outlet for said filter within said first passage to restrict oil flowing through said first passage outlet.

* * * * *